US006850719B2

(12) United States Patent
Nagaya

(10) Patent No.: US 6,850,719 B2
(45) Date of Patent: Feb. 1, 2005

(54) IMAGE FORMING APPARATUS AND PRINTER DRIVER PROGRAM

(75) Inventor: Takashi Nagaya, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/242,700

(22) Filed: Sep. 13, 2002

(65) Prior Publication Data

US 2003/0053817 A1 Mar. 20, 2003

(30) Foreign Application Priority Data

Sep. 17, 2001 (JP) ..... 2001/281498

(51) Int. Cl.[7] ..... G03G 15/00

(52) U.S. Cl. ..... 399/82; 399/8; 399/16; 399/407

(58) Field of Search ..... 399/8, 16, 81, 399/82, 85, 407, 410

(56) References Cited

U.S. PATENT DOCUMENTS 4,801,133 A 1/1989 Ishiguro et al. ..... 270/58.15
5,542,655 A * 8/1996 Murakami ..... 399/410 X
6,240,273 B1 * 5/2001 Kakigi ..... 399/410 X
6,263,173 B1 * 7/2001 Nakamura et al. ..... 399/82

FOREIGN PATENT DOCUMENTS

JP 63-139876 6/1988
JP 06-064829 * 3/1994

* cited by examiner

*Primary Examiner*—Sophia S. Chen
(74) *Attorney, Agent, or Firm*—Fitzpatrick, Cella, Harper & Scinto

(57) ABSTRACT

To prevent mixture of papers discharged by an image forming apparatus when sheet post-treatment equipment that executes post-treatment on papers discharged by the image forming apparatus post-treats papers supplied directly to the sheet post-treatment equipment by a user. When an off-line mode is selected via an operation panel of the sheet post-treatment equipment, a sheet post-treatment equipment controller notifies an engine controller of the image forming apparatus that this mode has been selected. The engine controller indicates on an operation panel that the off-line mode has been selected, and disables an image formation start instruction key.

16 Claims, 12 Drawing Sheets

IMAGE FORMING APPARATUS AND PRINTER DRIVER PROGRAM

BACKGROUND OF THE INVENTION

1. Field of the Invention

The present invention relates to an image forming apparatus that executes a predetermined process on a sheet with an image formed thereon, and a printer driver program installed in and executed by a host computer in order to allow the image forming apparatus to form images.

2. Related Background Art

Sheet post-treatment equipment is connected to an image forming apparatus such as an electrophotographic copier or a laser beam printer to execute a binding process or the like on papers discharged by the image forming apparatus. The sheet post-treatment equipment shifts sheet guides of a post-treatment section to a position corresponding to the size of a group of papers to be discharged, and then executes the binding process or the like by causing the sheet guides to align sheets discharged by the image forming apparatus.

The sheet post-treatment equipment connected to the image forming apparatus automatically post-treats papers discharged by the image forming apparatus and then bind (or staple) them. However, for the convenience of a user and the effective use of the sheet post-treatment equipment, it is desirable to have a function of allowing the user to insert papers directly into the sheet post-treatment equipment and then manually start post-treatment.

However, after the user has inserted the papers into the sheet post-treatment equipment and before the user gives an instruction for post-treatment, in order to manually start the post-treatment, if another user starts an image forming operation in the image forming apparatus, the inserted papers are mixed with papers discharged by the image forming apparatus, inside the sheet post-treatment equipment. This raises such a problem that it is impossible to manually start the post-treatment. Further, these papers, lying in the sheet post-treatment equipment, must be removed. This is cumbersome.

SUMMARY OF THE INVENTION

It is an object of the present invention to provide a sheet processing apparatus, an image forming apparatus, and a printer driver program, which serve to solve the above problems.

It is another object of the present invention to provide an image forming apparatus comprising image forming means for forming an image on a sheet, sheet processing means for executing a predetermined process on the sheet, selecting means for selecting either a first mode in which a predetermined process is executed on a sheet supplied by the image forming means or a second mode in which a predetermined process is executed on a sheet supplied to the sheet processing means by a user, and inhibiting means for inhibiting the image forming means from performing an image forming operation in response to selection of the second mode by the selection means.

It is still another object of the present invention to provide a printer driver program installed in and executed by a host computer in order to allow the image forming apparatus to form an image, the printer driver program being characterized by comprising a program for executing a determining step of determining whether or not the host computer is notified of the selection of the second mode in the sheet processing apparatus by notifying means, and an indicating step of indicating in a printer driver screen displayed on the display of the host computer that the image forming apparatus cannot execute the image forming operation, in response to determination that the selection of the second mode is notified, in the determining step.

The other objects and features of the present invention will be apparent from the following description and drawings.

DETAILED DESCRIPTION OF THE PREFERRED EMBODIMENTS

Figure 1:
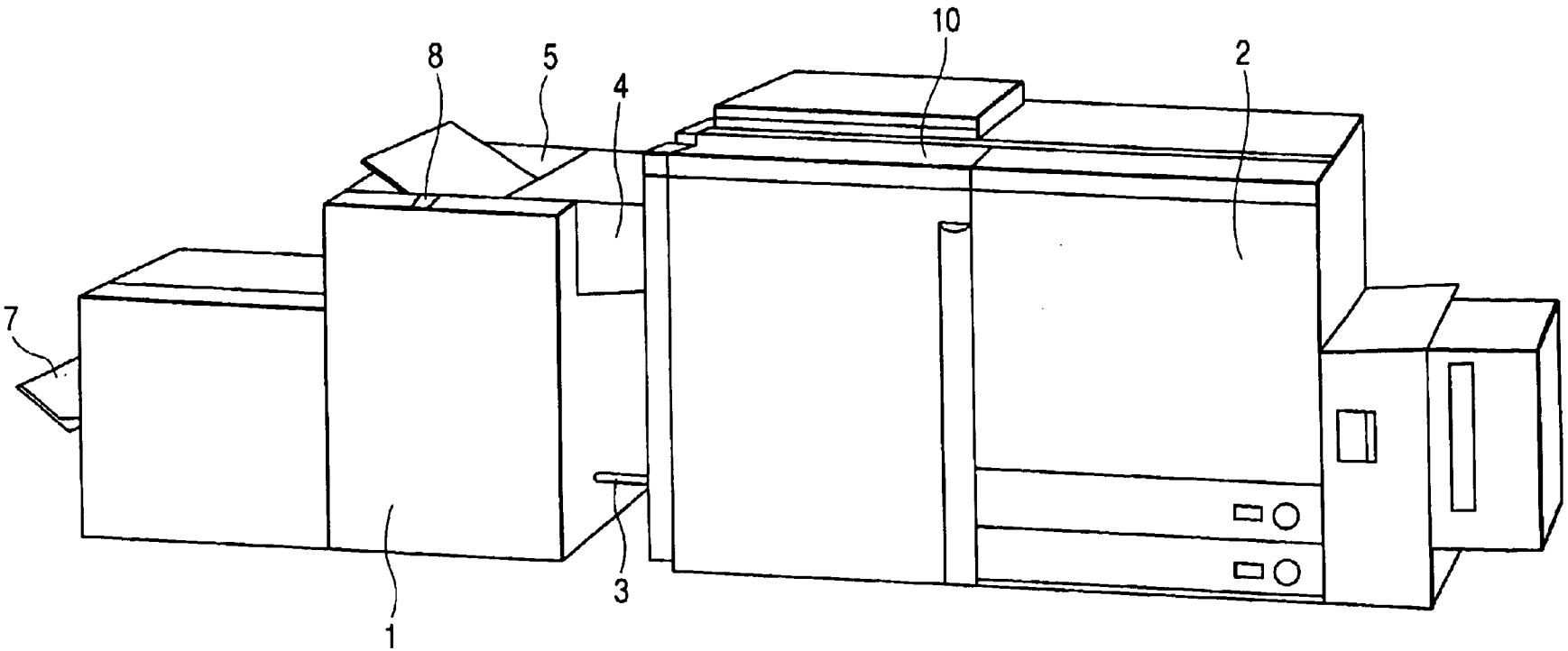
FIG. 1 is a perspective view of an image forming apparatus 2 and sheet post-treatment equipment 1 according to an embodiment of the present invention.
Figure 2:
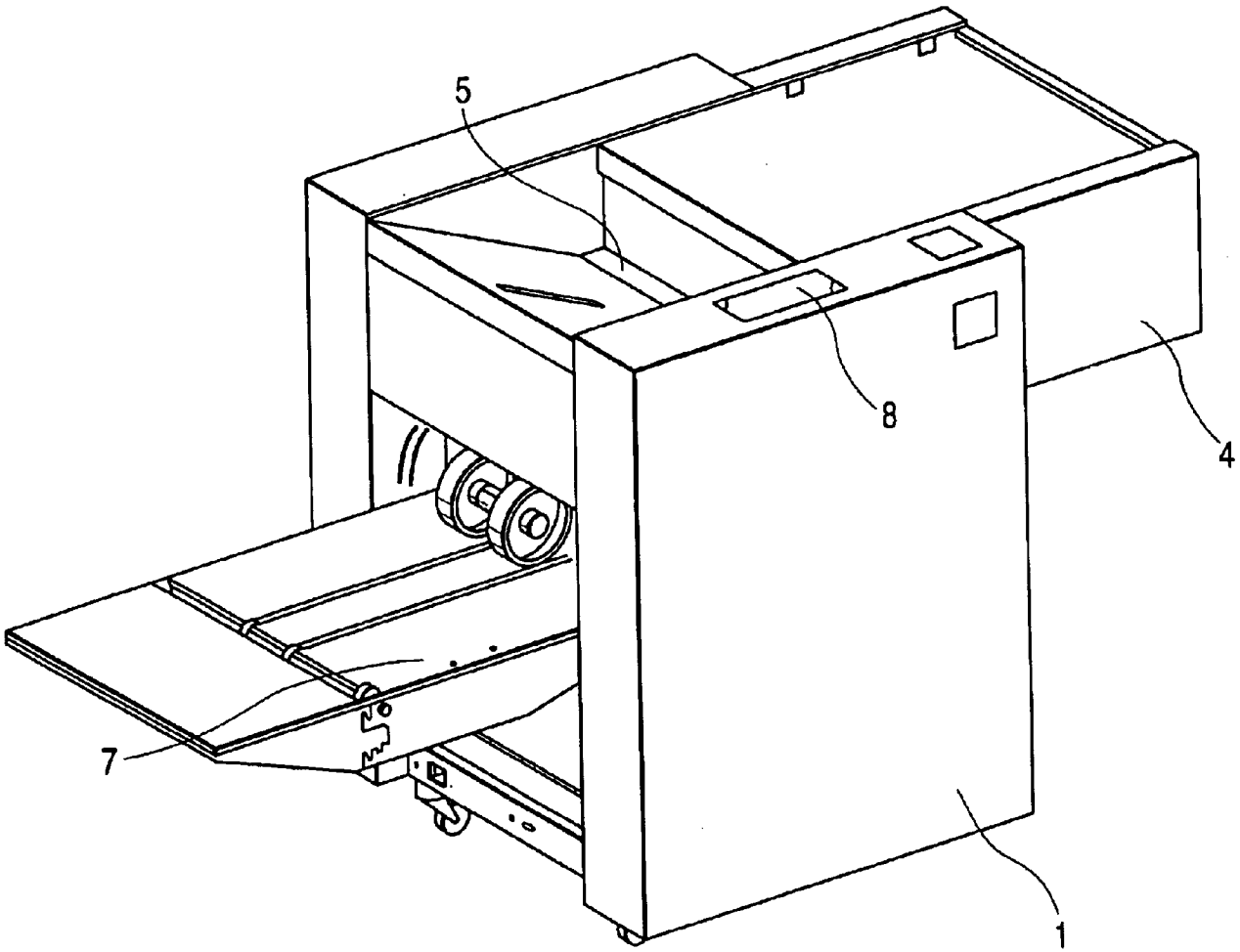
FIG. 2 is a perspective view of the sheet post-treatment equipment as viewed at another angle.
Figure 3:
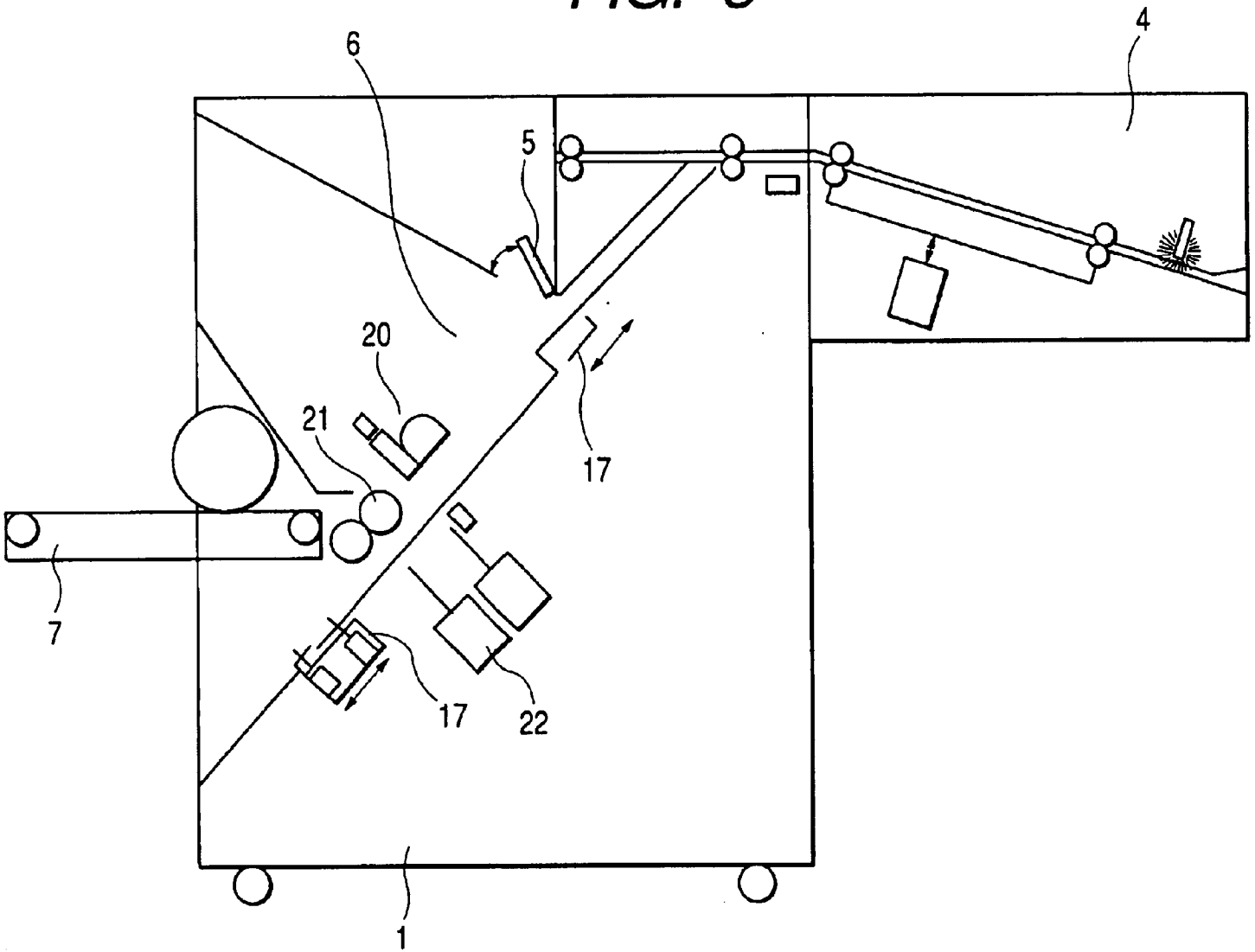
FIG. 3 is a sectional view of the sheet post-treatment equipment 1 as viewed from the front.

FIG. 1 is a perspective view of an image forming apparatus 2 and sheet post-treatment equipment 1 according to an embodiment of the present invention. FIG. 2 is a perspective view of the sheet post-treatment equipment as viewed at another angle. FIG. 3 is a sectional view of the sheet post-treatment equipment 1 as viewed from the front. The image forming apparatus 2 forms an image on paper and discharges the paper. The sheet post-treatment equipment 1 is connected to the image forming apparatus 2 to execute a binding operation papers discharged by the image forming apparatus, thereby producing bound papers. The image forming apparatus 2 and the sheet bound equipment 1 communicate information with each other via a communication line 3 as described later.

The sheet post-treatment equipment 1 selectively executes either an on-line or off-line mode. In the on-line mode, the sheet post-treatment equipment 1 operates synchronously on the basis of an instruction from the image forming apparatus 2. In the on-line mode, the image forming apparatus 2 transmits information on post-treatment to the sheet post-treatment equipment 1 via to signal line 3 on the basis of information input from an operation panel 10 of the image forming apparatus or information provided by external equipment such as a personal computer (not shown). The contents of the transmitted information include the size of papers, a post-treatment method, the number of papers contained in one copy (bundle or volume), and the number of copies (bundles or volumes). The sheet post-treatment equipment 1 executes a post-treatment operation on the basis of the information provided by the image forming apparatus 2. On the other hand, in the off-line mode, the sheet post-treatment equipment 1 operates asynchronously irrespective of instructions from the image forming apparatus 2. In the off-line mode, a user operates the operation panel 8 to specify a paper size, a post-treatment method, etc. to execute the post-treatment operation.

The sheet post-treatment equipment 1 comprises a post-treatment section 6 that staples papers, a conveying path 4 through which paper from the image forming apparatus 2 is introduced into the post-treatment section 6, a manual paper feeding slot 5 through which the user manually feeds the paper directly into the post-treatment section 6, a discharge section 7 that discharges post-treated (or bound) papers generated by the post-treatment section 6, and an operation panel 8. The post-treatment section 6 comprises movable sheet guides 17 that adjust alignment and folding positions of papers in a paper conveying direction (sub-scanning direction) and a corresponding cross direction (main scanning direction) depending on the size of papers to be treated. The post-treatment section 6 also comprises a stapler 20 that binds papers, a roller 21 that folds papers, and a movable plate 22 that pushes papers against the roller 21. These arrangements enable the post-treatment section 6 to produce post-treated papers such as a magazine or a pamphlet. Further, the image forming apparatus 2 comprises well-known means for forming images and the operation panel 10. The manual paper feeding slot 5 is constructed so as to be manually opened and closed.

Figure 4:
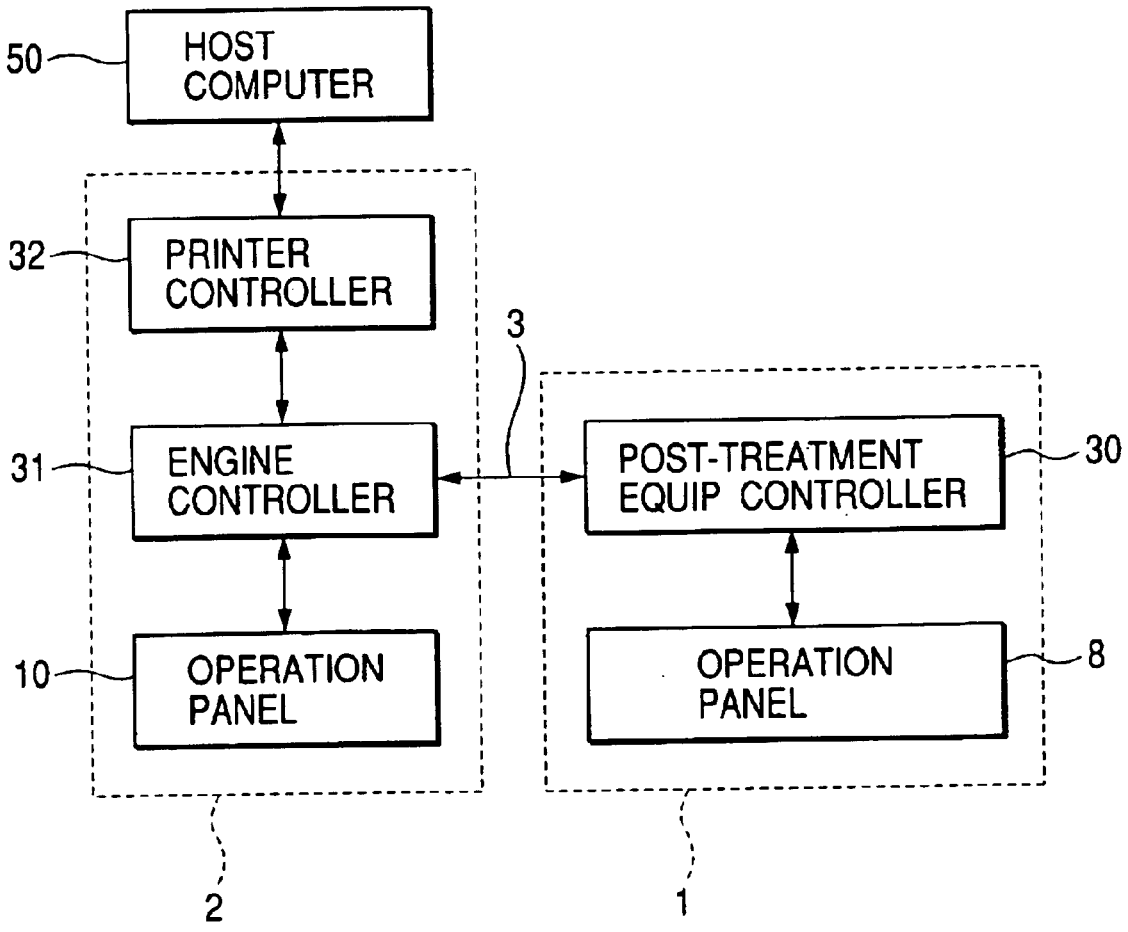
FIG. 4 is a block diagram of the sheet post-treatment equipment 1 and the image forming apparatus 2.

FIG. 4 is a block diagram of the sheet post-treatment equipment 1 and the image forming apparatus 2. A sheet post-treatment equipment controller 30 controls the sheet post-treatment equipment 1 on the basis of information received from the image forming apparatus 2 via the signal line 3 or information input from the operation panel 8. An engine controller 31 controls a copying operation (image forming operation) performed by the image forming apparatus 2 on the basis of the information input from the operation panel 10, and controls a printing operation (image forming operation) performed by the image forming apparatus 2 on the basis of image information and control information input by a printer controller 32. The printer controller 32 generates image information and control information for the engine controller 31 on the basis of a print job containing a page description language and a control command, received from a host computer 50 and output them to the engine controller 31.

Figure 5:
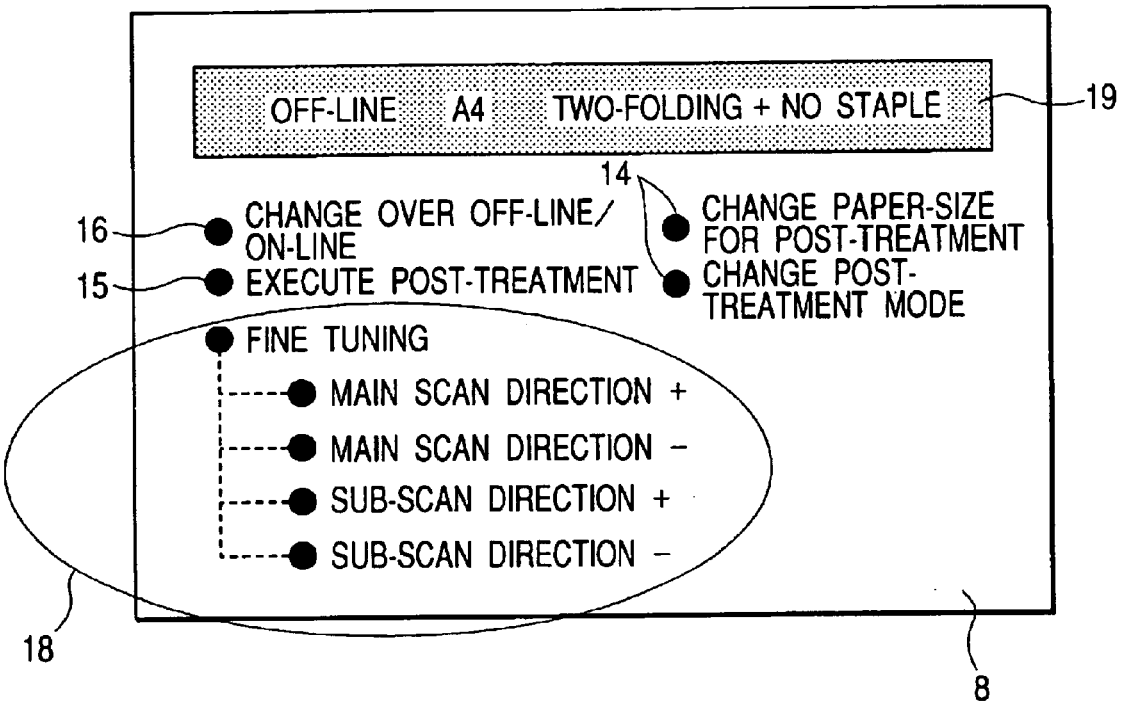
FIG. 5 is a diagram showing an operation panel 8 provided on the sheet post-treatment equipment 1.

FIG. 5 is a diagram showing the operation panel 8 provided on the sheet post-treatment equipment 1. The operation panel 8 comprises an off-line post-treatment information input key 14 used to input information on post-treatment such as the size of papers to be post-treated and a post-treatment mode, a post-treatment execution key 15 used to start post-treatment in the off-line mode, a sheet post-treatment equipment mode change-over key 16 used to determine whether the sheet post-treatment equipment is operated in the off-line or on-line mode, a sheet guide position fine-tuning key 18 used to fine-tune the positions of the sheet guides 17 in the main scanning direction and sub-scanning direction, and a display 19 that displays the size of papers to be post-processed, the post-treatment mode, the on-line mode/off-line mode, or the like.

Figure 6:
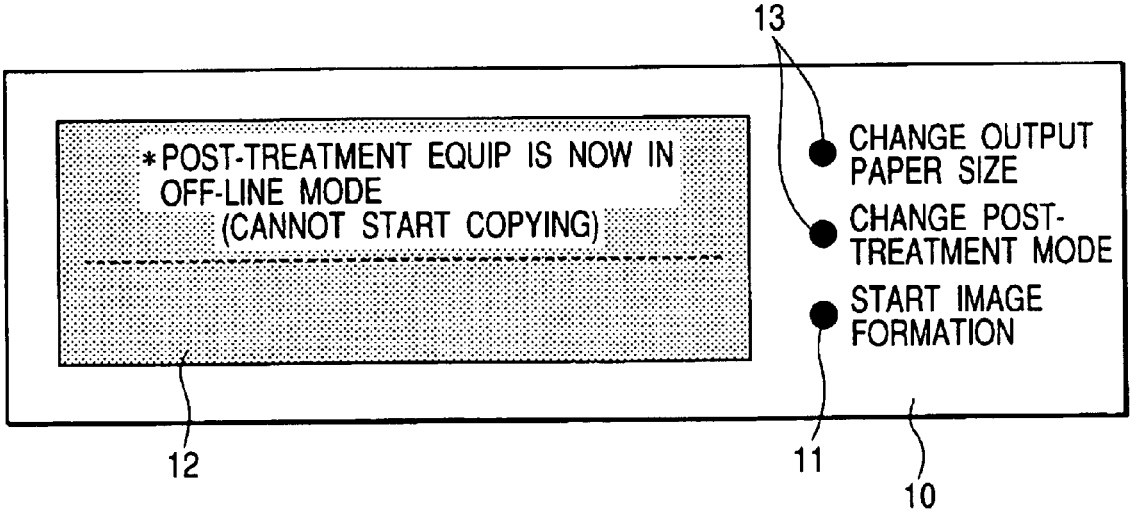
FIG. 6 is a diagram showing an operation panel 10 provided on the image forming apparatus 2.

FIG. 6 is a diagram showing the operation panel 10 provided on the image forming apparatus 2. The operation panel 10 comprises an image formation start key 11, a display 12 that displays the contents of an image formation mode and the post-treatment mode, and an on-line post-treatment information input key 13 used to input information on post-treatment such as the size of papers and the post-treatment mode.

Figure 7:
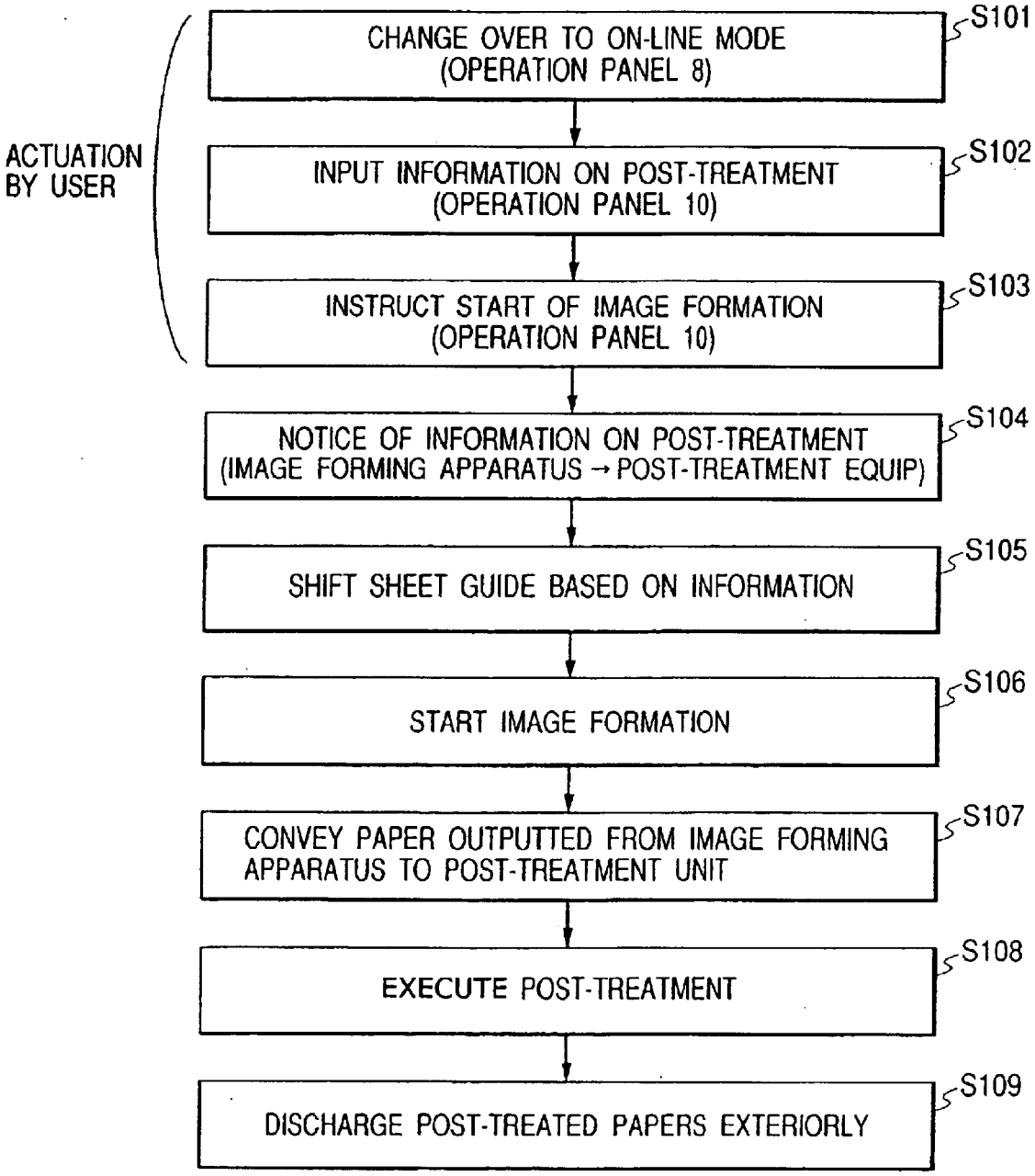
FIG. 7 is a flow chart showing the case in which a user uses an on-line mode.

FIG. 7 is a flow chart showing the case in which a user uses an on-line mode. If the on-line mode is used, the user uses the sheet post-treatment equipment mode change-over key 16 on the operation panel 8 to specify the on-line mode (S101). Then, the user inputs information on post-treatment, i.e. the size of papers, the type of the papers, a post-treatment method (two-folding: yes/no, binding process: yes/no, trimming: yes/no), the number of papers contained in one copy (bundle or volume), and the number of copies (bundles or volumes), using the on-line post-treatment information input key 13 on the image forming apparatus operation panel 10 of the image forming apparatus or using external equipment (not shown) connected to the image forming apparatus 2 (S102). Then, the user gives an instruction to start an image output, using the image formation start key 11 of the operation panel 10 of the image forming apparatus 2 or using the external equipment (not shown) connected to the image forming apparatus 2 (S103), thus allowing the image forming apparatus 2 to automatically provide information on post-treatment to the sheet post-treatment equipment 1 via the signal line 3 (S104). On the basis of the provided information on the post-treatment, the post-treatment section 6 of the sheet post-treatment equipment 1, for example, shifts the sheet guides 17 in the main scanning direction and sub-scanning direction to positions corresponding to the size of papers (S105). Once the sheet guides 17 have been completely shifted, the image forming apparatus 2 starts outputting paper (S106). The outputted paper is conveyed through the conveying path 4 to the post-treatment section 6 (S107). A group of papers housed in the post-treatment section 6 are post-treated on the basis of the provided information on the post-treatment (S108) and then discharged out of the apparatus through the discharge section 7 (S109).

Figure 8:
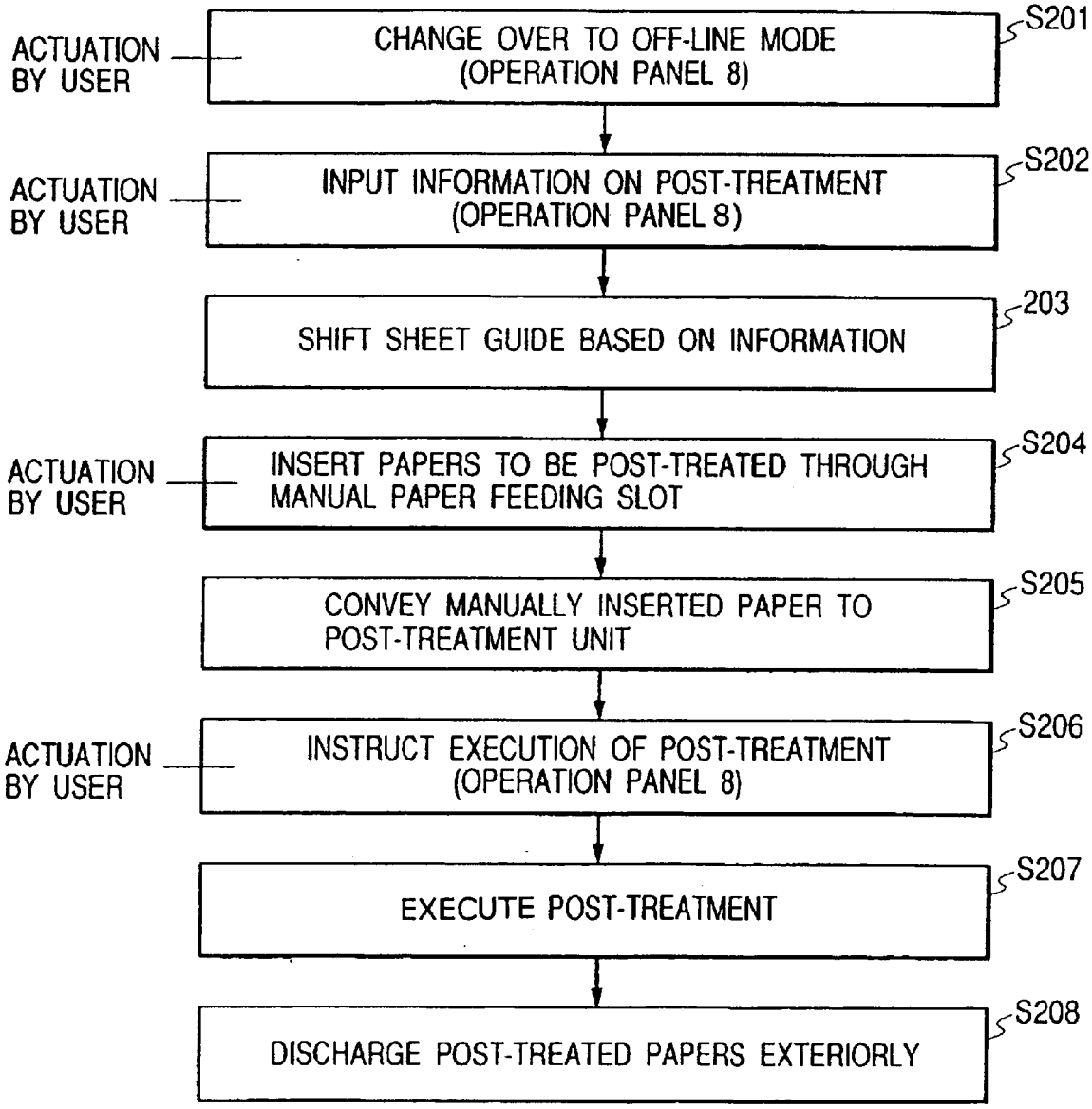
FIG. 8 is a flow chart showing the case in which the user uses an off-line mode.

FIG. 8 is a flow chart showing the case in which the user uses an off-line mode. If the off-line mode is used, the user uses the sheet post-treatment equipment mode change-over key 16 on the operation panel 8 to specify the off-line mode (S201). Then, the user inputs information on post-treatment, i.e. the size of papers, the type of the papers, a post-treatment method (two-folding: yes/no, binding process: yes/no, trimming (trimming an end of post-treated or bound papers): yes/no), the number of papers contained in one copy (bundle or volume), etc., using the off-line post-treatment information input key 14 on the operation panel 8 of the image forming apparatus (S202). On the basis of the provided information on the post-treatment, the post-treatment section 6 of the sheet post-treatment equipment 1, for example, shifts the sheet guides 17 in the main scanning direction and sub-scanning direction to positions corresponding to the size of papers (S203). Then, the user inserts a bundle of papers to be post-processed into the manual paper feeding slot 5 (S204). The bundle of papers inserted through the manual paper feeding slot 5 are conveyed to the post-treatment section 6 (S205). Then, the user gives an instruction to start the post-treatment, using the post-treatment execution key 15 on the operation panel 8 (S206). Thus, the group of papers housed in the post-treatment section 6 are post-treated on the basis of the provided information on the post-treatment (S207) and then discharged out of the apparatus through the discharge section 7 (S208).

Figure 9:
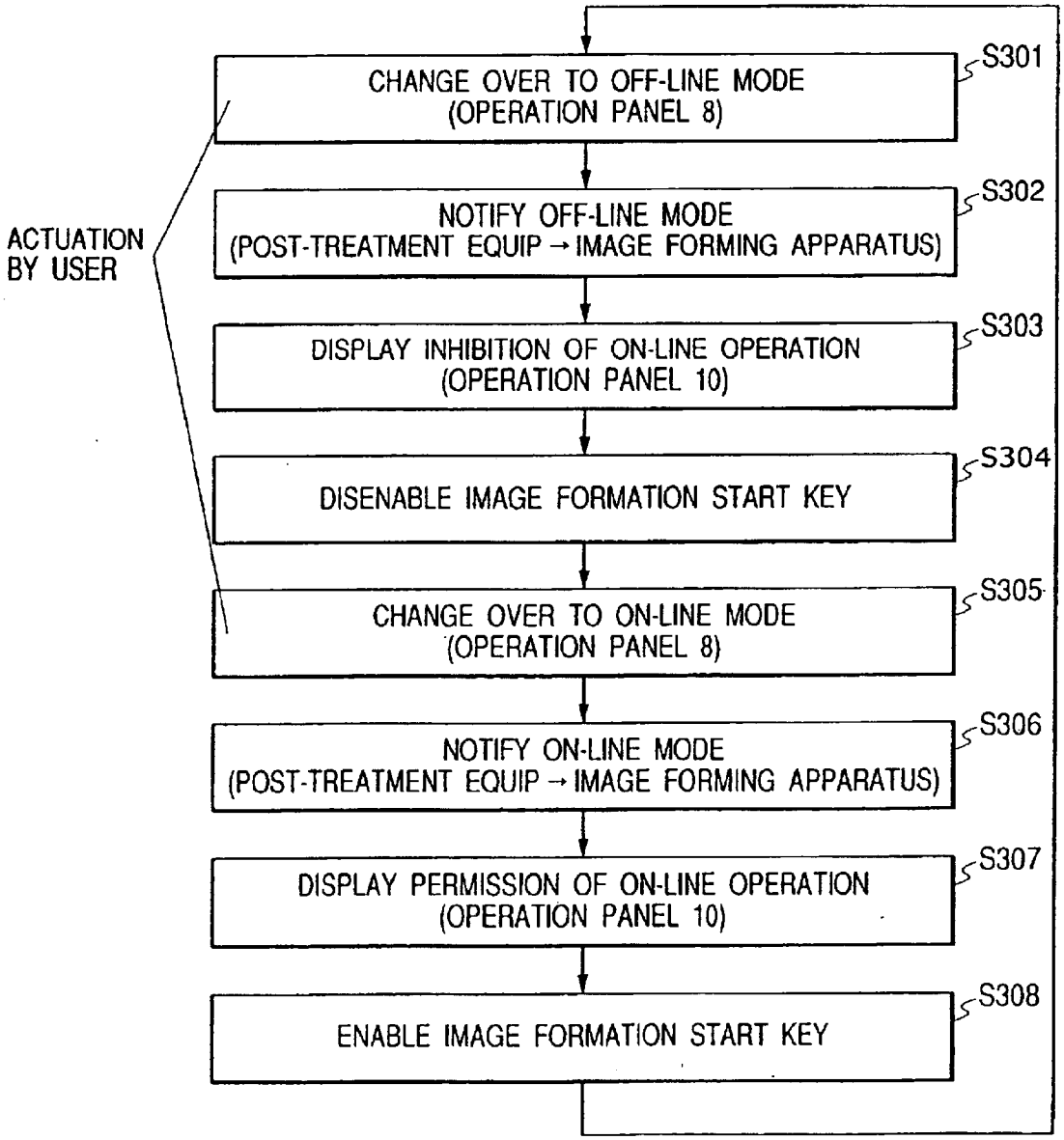
FIG. 9 is a flow chart showing a process executed by the operation panel 10.

FIG. 9 is a flow chart showing a process executed by the operation panel 10 when the operation mode of the sheet post-treatment equipment 1 is alternately changed over to the on-line and off-line modes. When the user specifies the off-line mode using the sheet post-treatment equipment mode change-over key 16 on the operation panel 8 (S301), the sheet post-treatment equipment 1 notifies the image forming apparatus 2 of the off-line mode via the signal line 3 (S302). Notified of the off-line mode, the image forming apparatus 2 indicates on the display 12 of the operation panel 8 that the sheet post-treatment equipment 1 is in the off-line mode. It also indicates that an image formation start instruction, given using the image formation start key 11, is inhibited (S303), thereby disabling the image formation start key 11 (S304). At the same time, the externally connected equipment (not shown) displays similar information to disable the image formation start instruction. This information is continuously displayed with the image formation start instruction continuously disabled until the user specifies the on-line mode using the sheet post-treatment equipment mode change-ver key 16 on the operation panel 8.

When the user specifies the on-line mode using the sheet post-treatment equipment mode change-over key 16 on the operation panel 8 (S305), the sheet post-treatment equipment 1 notifies the image forming apparatus 2 of the on-line mode via the signal line 3 (S306). Notified of the on-line mode, the image forming apparatus 2 indicates on the display 12 of the operation panel 8 that the sheet post-treatment equipment 1 is in the on-line mode. It also indicates that the image formation start instruction, given using the image formation start key 11, is enabled (S307), thereby enabling the image formation start key 11 (S308). At the same time, the externally connected equipment (not shown) displays similar information to enable the image formation start instruction. This information is continuously enabled with the image formation start instruction continuously enabled until the user specifies the off-line mode using the sheet post-treatment equipment mode change-ver key 16 on the operation panel 8.

Figure 10:
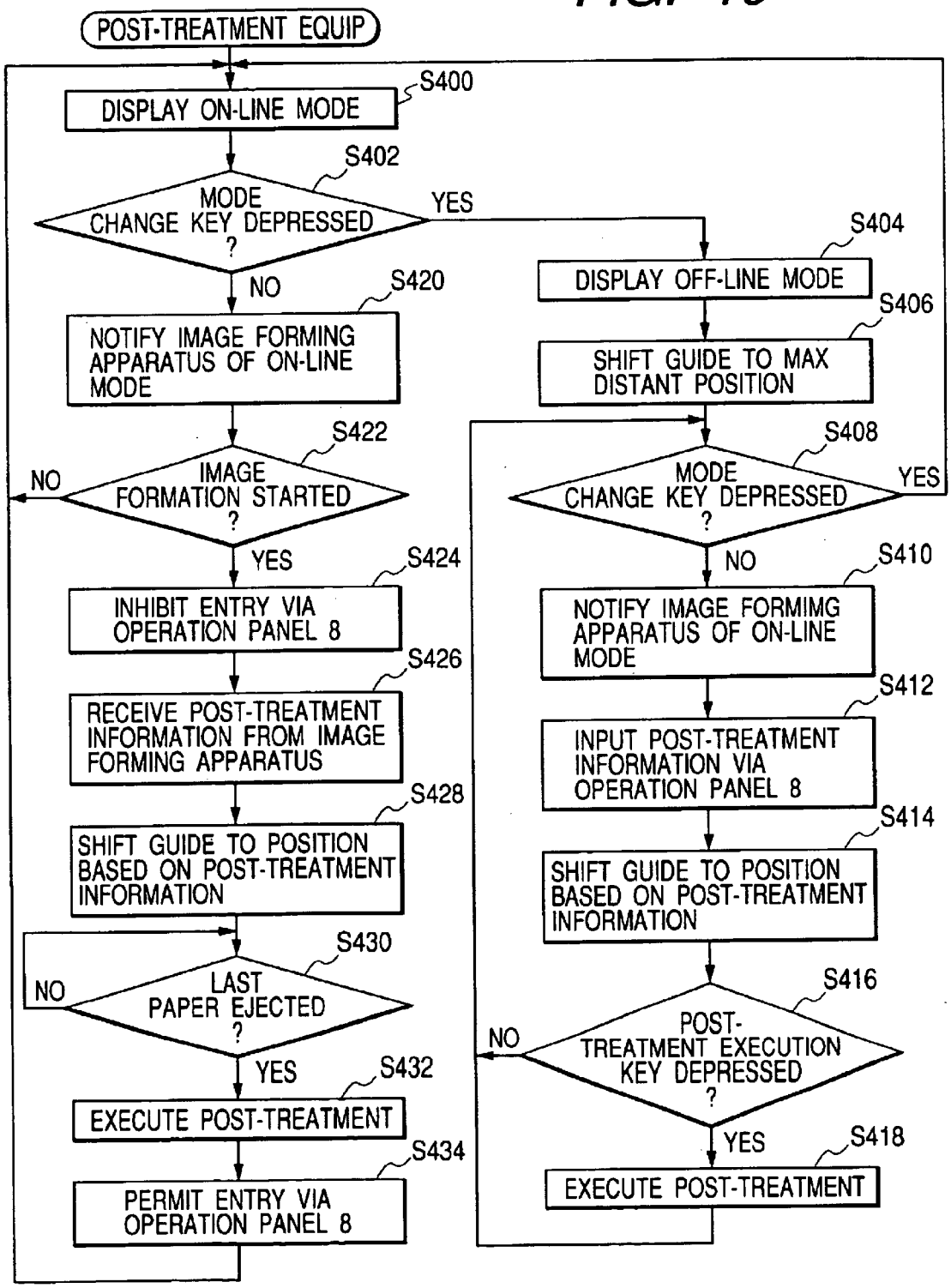
FIG. 10 is a control flow chart for the sheet post-treatment equipment 1.

FIG. 10 is a flow chart showing how the sheet post-treatment equipment 1 is controlled by the sheet post-treatment equipment controller 30. When the sheet post-treatment equipment 1 is turned on, the display 12 on the operation panel 8 indicates the on-line mode (S400). Then, when the sheet post-treatment equipment mode change-over key 16 is depressed (S402), the display 12 indicates the off-line mode as shown in FIG. 5 (S404). The sheet guides 17 are shifted to their max distant positions (S406). When the sheet post-treatment equipment mode change-over key 16 is depressed (S408), the process returns to step S400. If the sheet post-treatment equipment mode change-over key 16 is not depressed, the sheet post-treatment equipment controller 30 notifies the engine controller 31 of the image forming apparatus 2 that the sheet post-treatment equipment 1 is in the off-line mode (S410). The sheet post-treatment equipment controller 30 then inputs post-treatment information set by the user, via the operation panel 8 (S412). Then, the sheet post-treatment equipment controller shifts the sheet guides 17 to positions corresponding to the post-treatment information (post-treatment paper size information) (S414). Then, the sheet post-treatment equipment controller determines whether or not the post-treatment execution key 15 has been depressed (S416). If this key 15 has not been depressed, the process returns to step S408. If this key 15 has been depressed, the sheet post-treatment equipment controller causes the sheet post-treatment equipment 1 to execute the post-treatment corresponding to the post-treatment information (S418). The process then returns to step S408.

If it is determined at step S402 that the sheet post-treatment equipment mode change-over key 16 has not been depressed, the sheet post-treatment equipment controller notifies, via the signal line 3, the engine controller 31 of the image forming apparatus 2 that the sheet post-treatment equipment 1 is in the on-line mode (S420). The sheet post-treatment equipment controller then determines whether or nor the image forming apparatus 2 has started an image forming operation (S422). If the image forming apparatus 2 has not started an image forming operation, the process returns to step S400. If the image forming apparatus 2 has started an image forming operation, the sheet post-treatment equipment controller inhibits entries via the operation panel 8 (S424) and receives post-treatment information from the engine controller 31 (S426) via the signal line 3. Then, the sheet post-treatment equipment controller shifts the sheet guides 17 to positions corresponding to this post-treatment information (paper size information) (S428). Then, notified by the engine controller 31 that the last paper has been discharged (S430), the sheet post-treatment equipment controller causes the sheet post-treatment equipment 1 to execute the post-treatment corresponding to the post-treatment information (S432) and permits entries via the operation panel 8 (S434). The process then returns to step S400.

In view of such cases that the image forming apparatus 2 may be required to form a plurality of sets of images or an instruction to perform a different image forming operation may be given during an image forming operation, the process of the sheet port-treatment equipment controllers may be changed in the following manner. That is, the engine controller 31 provides the sheet post-treatment equipment controller 30 with information indicating that an image forming operation is being performed. Then, after the processing at step S432, the sheet post-treatment equipment controller determines whether or not the information indicating that an image forming operation is being performed is received. If an image forming operation is being performed, the process returns to step S430. Otherwise, i.e. if the image forming apparatus 2 has discharged the last paper to complete the image forming operation, the process may proceed to step S434.

Figure 11:
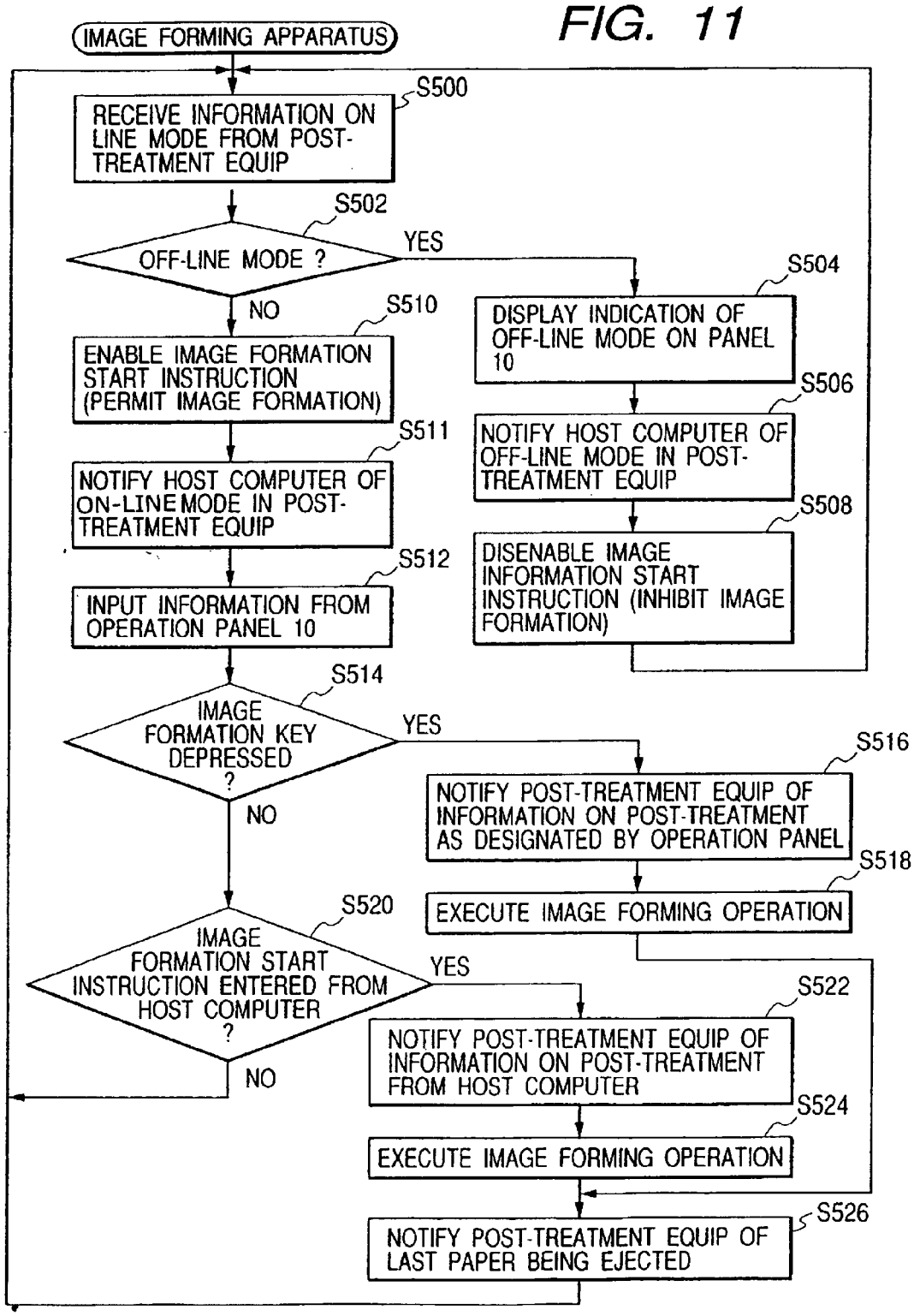
FIG. 11 is a control flow chart for the image forming apparatus 2.

FIG. 11 is a flow chart showing how the image forming apparatus 2 is controlled by the engine controller 31. First, the engine controller 31 receives information, via the communication line 3 from the sheet post-treatment equipment controller 30 of the sheet post-treatment equipment 1, indicating whether the sheet post-treatment equipment is in the on-line or off-line mode (S500). Upon receiving information from the sheet post-treatment equipment controller 30 indicating that the sheet post-treatment equipment is in the off-line mode (S502), the engine controller indicates on the display 12 on the operation panel 10 of the image forming apparatus 2 that the sheet post-treatment equipment 1 is operating in the off-line mode (S504). Then, the engine controller notifies the printer controller 32 that the sheet post-treatment equipment is in the off-line mode. The printer controller 32 then notifies the host computer 50 that the sheet post-treatment equipment is in the off-line mode (S506). Then, the engine controller 31 disables the image formation start instruction, i.e. inhibits the image forming operation (S508). Specifically, the engine controller 31 provides such control that the image forming apparatus does not respond to depression of the image formation start key 11 and notifies the printer controller 32 that no images can be formed. Notified of this, the printer controller 32 accepts a spool of a print job from the host computer 50 and reserves the image formation start instruction given to the engine controller 31. After step S508, the engine controller 31 returns to step S500.

At step S502, upon receiving information from the sheet post-treatment equipment controller 30 indicating that the sheet post-treatment equipment is in the on-line mode, the engine controller enables the image formation start instruction, i.e. permits an image forming operation (S510). Specifically, the engine controller provides such control that the image forming apparatus responds to the image formation start key 11 and notifies the printer controller 32 that images can be formed. Notified of this, the printer controller 32 outputs image information and control information to the engine controller 31 in order to cause the spooled and reserved print job to form an image. Then, the engine controller 31 notifies the printer controller 32 that the sheet post-treatment equipment is in the on-line mode. The printer controller 32 then notifies the host computer 50 that the sheet post-2 treatment equipment is in the on-line mode (S511). Then, engine controller 13 receives information from the operation panel 10 (S512) to determine whether or not the image formation start key 11 has been depressed (S514). If the image formation start key 11 has not been depressed, the engine controller determines whether or not an image formation start instruction is entered from the host computer 50 (S520). If the image formation start instructions is not entered, the process returns to step S500.

If the engine controller determines at step S514 that the image formation start key 11 has been depressed, it transmits the post-treatment information set via the operation panel 10, to the sheet post-treatment equipment controller 30 via the communication line 3 (S516). The engine controller then causes the image forming apparatus 2 to perform an image forming operation of reading originals set on the image forming apparatus 2 and forming the corresponding images on paper (S518). Once one group of originals have been subjected to an image forming operation, the engine controller notifies the sheet post-treatment equipment controller 30 that the last paper has been discharged (S526). The process then returns to step S500. On the other hand, if the engine controller determines at step S520 that the image formation start instruction is entered from the host computer 50, it transmits the post-treatment information from the host computer 50 to the sheet post-treatment equipment controller 30 via the communication line 3 (S522). The engine controller then causes the image forming apparatus 2 to perform an image forming operation of forming an image on paper on the basis of the image information and control information input by the printer controller 32 (S524). The process then proceeds to step S526.

Figure 12:
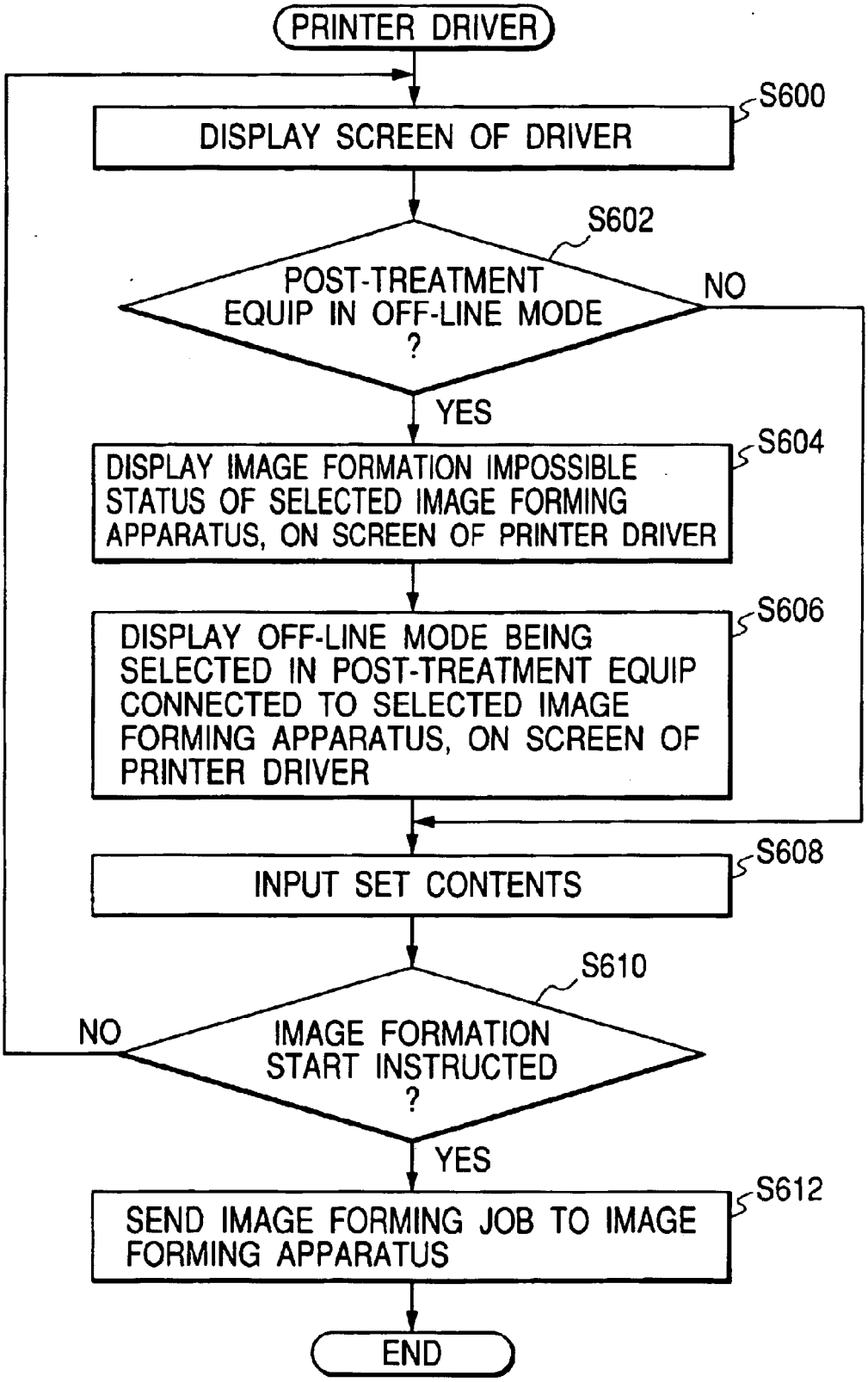
FIG. 12 is a control flow chart for a printer driver program executed by a host computer 50.

FIG. 12 is a control flow chart for a printer driver program installed in and executed by the host computer 50 so that the host computer 50 can cause the image forming apparatus 2 to form images. The printer driver program is read from a floppy disk or a CD-ROM and then installed in the host computer 50 or is downloaded from a server via the Internet or the like and then installed in the host computer 50.

Figure 13:
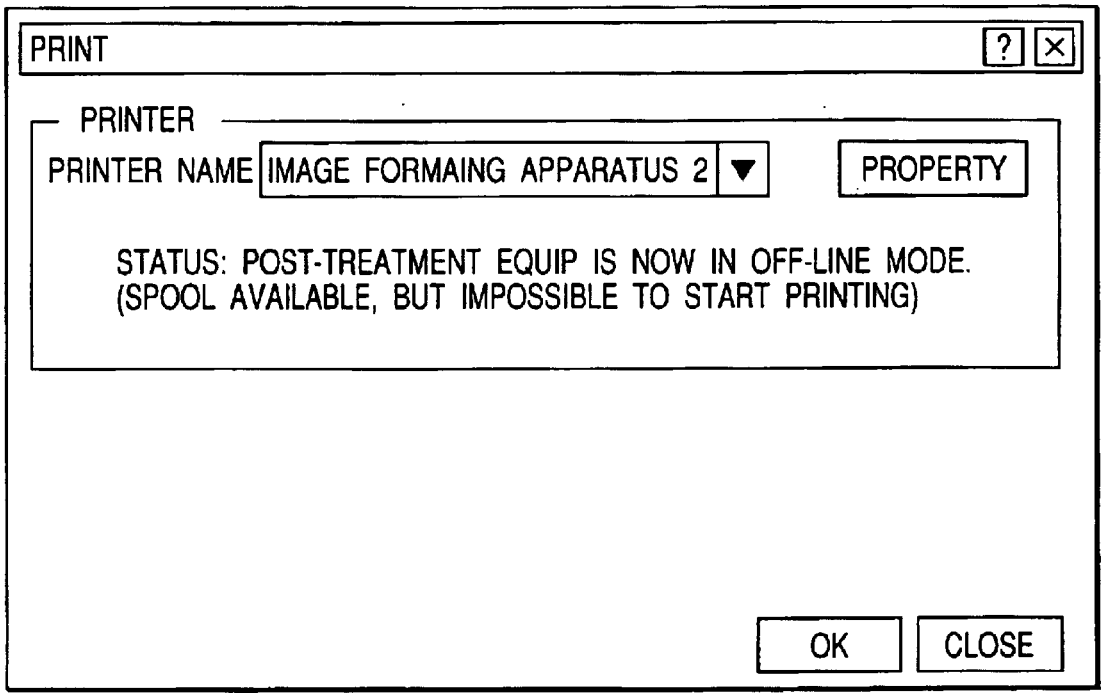
FIG. 13 is a diagram showing a display screen of a printer driver of the host computer 50.

When the printer driver program installed in the host driver 50 is activated, a printer driver screen is displayed (S600). Then, it is determined whether or not the image forming apparatus 2 has notified the host computer that the off-line mode has been selected in the sheet post-treatment equipment 1 (S602). If the off-line mode has been selected in the sheet post-treatment equipment 1, the printer driver screen indicates that the selected image forming apparatus cannot form any images ("Impossible to start printing") as shown in FIG. 13 (S604). The printer driver screen also indicates that the off-line mode has been selected in the sheet post-treatment equipment 1 connected to the selected image forming apparatus 2 ("Sheet post-treatment equipment is now in off-line mode") (S606). Then, the contents of information set on the printer driver screen are entered (S608). If it is determined at step S602 that the host computer has not been notified that the off-line mode has been selected, then the process proceeds to step S608.

After step S608, it is determined whether or not an image forming start instruction has been given, i.e. an OK button has been clicked (S610). If the image forming start instruction has not been given, the process returns to step S600. Otherwise, an image forming job is transmitted to the image forming apparatus 2 (S612). Then, the process is ended.

As described above, according to the sheet processing apparatus of the present invention, it is possible to select either a first mode in which a predetermined process is executed on a sheet supplied by the image forming apparatus or a second mode in which a predetermined process is executed on a sheet supplied to the sheet processing apparatus by the user. Further, information indicative of a selected mode is transmitted to the image forming apparatus. This enables the image forming apparatus to be prevented from starting an image forming operation when the second mode is selected in the sheet processing apparatus.

Furthermore, if the first mode is selected, the first or second mode can be selected before the image forming apparatus starts the image forming operation. On the other hand, the selection of the first or second mode is inhibited after the image forming apparatus has started the image forming operation. This provides the advantage that sheets already discharged by the image forming apparatus are not influenced.

Moreover, the inhibition of selection of the first or second mode is canceled after the image forming apparatus has discharged the last sheet to complete the image forming operation. Consequently, the user can select the first or second mode without being troubled after the image forming apparatus has discharged the last sheet to complete the image forming operation.

Further, the present invention provides an image forming apparatus which forms an image on a sheet and to which the sheet processing apparatus is connected, characterized in that information indicative of a selected one of the first and second mode is received, and when the received information is indicative of the second mode, the image forming operation is inhibited. This prevents sheets discharged by the image forming apparatus from being mixed with sheets set in the sheet processing apparatus by the user.

Furthermore, in response to the received information indicating the second mode, an instruction to start an image forming operation of forming a read original image on a sheet is disabled. Consequently, the simple configuration can be used to prevent sheets from the image forming apparatus from being mixed.

Moreover, in response to the received information indicating the second mode, information indicating that no images can be formed is displayed. Accordingly, the user can be notified beforehand that no images can be formed.

Furthermore, in response to the received information indicating the second mode, information indicating that the second mode has been selected is displayed. Accordingly, the user can be notified beforehand that the second mode has been selected.

Moreover, in response to the received information indicating the second mode, the host computer is notified that the second mode has been selected in the sheet processing apparatus. Consequently, the host computer can determine that the second mode has been selected in the sheet processing apparatus.

Furthermore, spooling of image information from the host computer is not inhibited but the image forming operation based on the spooled image information is reserved and thus the image forming operation is inhibited. This prevents mixture of sheets and ensures the host computer user's convenience.

Further, the present invention provides a printer driver program installed in and executed by the host computer in order to allow the image forming apparatus to form an image. With this printer driver program, it is determined whether or not the host computer has been notified that the second mode has been selected in the sheet processing apparatus. In response to the determination that the second mode has been selected, the printer driver screen, displayed on the display of the host computer, indicates that the image forming apparatus cannot form any images. Accordingly, the host computer user can be notified beforehand that no images can be formed.

Furthermore, the present invention provides a printer driver program installed in and executed by the host computer in order to allow the image forming apparatus to form an image. With this printer driver program, it is determined whether or not the host computer has been notified that the second mode has been selected in the sheet processing apparatus. In response to the determination that the second mode has been selected, the printer driver screen, displayed on the display of the host computer, indicates that the second mode has been selected in the sheet processing apparatus. Accordingly, the host computer user can be notified beforehand that the second mode has been selected in the sheet processing apparatus.

What is claimed is:

1. An image forming apparatus comprising:

image forming means for forming an image on a sheet;

sheet processing means for executing a predetermined process on the sheet;

selecting means for selecting either a first mode in which the predetermined process is executed on a sheet supplied to said sheet processing means by said image forming means, or a second mode in which a predetermined process is executed on a sheet supplied to said sheet processing means by a user;

inhibiting means for inhibiting said image forming means from performing an image forming operation in response to a selection of the second mode by said selecting means; and display means for indicating that the image forming operation cannot be performed, in response to a selection of the second mode by said selecting means.

2. An image forming apparatus comprising:

image forming means for forming an image on a sheet;

sheet processing means for executing a predetermined process on the sheet;

selecting means for selecting either a first mode in which the predetermined process is executed on a sheet supplied to said sheet processing means by said image forming means, or a second mode in which a predetermined process is executed on a sheet supplied to said sheet processing means by a user;

inhibiting means for inhibiting said image forming means from performing an image forming operation in response to a selection of the second mode by said selecting means; and notifying means for notifying a host computer that the second mode has been selected, in response to the selection of the second mode by said selecting means.

3. An image forming apparatus according to claim 2, wherein said inhibiting means does not inhibit spooling of image information received from a host computer but reserves and thus inhibits the image forming operation based on spooled image information.

4. An image forming apparatus comprising:

image forming means for forming an image on a sheet;

sheet processing means for executing a predetermined process on the sheet;

selecting means for selecting either a first mode in which the predetermined process is executed on a sheet supplied to said sheet processing means by said image forming means, or a second mode in which a predetermined process is executed on a sheet supplied to said sheet processing means by a user, wherein if said selecting means selects the first mode, said selecting means carries out a selection before said image forming apparatus starts an image forming operation, and said selecting means is inhibited from carrying out the selection after said image forming apparatus has started the image forming operation; and inhibiting means for inhibiting said image forming means from performing the image forming operation in response to a selection of the second mode by said selecting means.

5. An image forming apparatus according to claim 4, wherein said inhibiting means cancels an inhibition of a selection by said selecting means after said image forming apparatus has discharged a last sheet to complete the image forming operation.

6. An image forming apparatus, which is attachable to a sheet processing apparatus, which includes selecting means for selecting either a first mode in which a predetermined process is executed on a sheet supplied by said image forming apparatus, or a second mode in which a predetermined process is executed on a sheet supplied to the sheet processing means by a user, said image forming apparatus comprising:

image forming means for forming an image on a sheet;

receiving means for receiving, from transmitting means, information indicative of a mode selected by the selecting means; and inhibiting means for inhibiting an image forming operation in response to the information received by said receiving means indicating the second mode has been selected.

7. A printer driver program installed in and executed by a host computer in order to allow an image forming apparatus including: image forming means for forming an image on a sheet; sheet processing means for executing a predetermined process on the sheet; selecting means for selecting either a first mode in which the predetermined process is executed on a sheet supplied to the sheet processing means by the image forming means, or a second mode in which a predetermined process is executed on a sheet supplied to the sheet processing means by a user; inhibiting means for inhibiting the image forming means from performing an image forming operation in response to a selection of the second mode by the selecting means; and notifying means for notifying a host computer that the second mode has been selected, in response to the selection of the second mode by the selecting means, to form an image, said printer driver program comprising a program for executing the steps of:

determining whether the host computer is notified of the selection of the second mode in the sheet processing means, by the notifying means; and indicating that the image forming apparatus cannot execute the image forming operation, in a printer driver screen displayed on a display of a host computer, in response to a determination that the selection of the second mode is notified, in said determining step.

8. A printer driver program installed in and executed by a host computer in order to allow an image forming apparatus including: image forming means for forming an image on a sheet; sheet processing means for executing a predetermined process on the sheet; selecting means for selecting either a first mode in which the predetermined process is executed on a sheet supplied to the sheet processing means by the image forming means, or a second mode in which a predetermined process is executed on a sheet supplied to the sheet processing means by a user; inhibiting means for inhibiting the image forming means from performing an image forming operation in response to a selection of the second mode by the selecting means; and notifying means for notifying the host computer that the second mode has been selected, in response to the selection of the second mode by the selecting means, to form an image, said printer driver program comprising a program for executing the steps of:

determining whether the host computer is notified of the selection of the second mode in the sheet processing means, by the notifying means; and indicating that the second mode has been selected in the sheet processing means, in a printer driver screen displayed on a display of the host computer, in response to a determination that the selection of the second mode is notified, in said determining step.

9. An image forming apparatus comprising:

an image forming device, which forms an image on a sheet;

sheet processing equipment, which performs a predetermined process on the sheet;

a change-over controller, which selects either a first mode in which the predetermined process is executed on a sheet supplied to said sheet processing equipment by said image forming device, or a second mode in which a predetermined process is executed on a sheet supplied to said sheet processing equipment by a user;

an inhibiting controller, which inhibits said image forming device from performing an image forming operation in response to a selection of the second mode by said change-over controller; and an indicating device, which responds to the selection of the second mode by said change-over controller, and which provides an indication that the image forming operation cannot be performed.

10. An image forming apparatus comprising:

image forming device, which forms an image on a sheet;

sheet processing equipment, which performs a predetermined process on the sheet;

a change-over controller, which selects either a first mode in which the predetermined process is executed on a sheet supplied to said sheet processing equipment by said image forming device, or a second mode in which a predetermined process is executed on a sheet supplied to said sheet processing equipment by a user;

an inhibiting controller, which inhibits said image forming device from performing an image forming operation in response to a selection of the second mode by said change-over controller; and a notifying device, which is responsive to the selection of the second mode by said change-over controller that the second mode has been selected, and which notifies a host computer that the second mode has been selected.

11. An image forming apparatus according to claim 10, wherein said inhibiting controller does not inhibit spooling of the image information from the host computer but reserves and thus inhibits the image forming operation based on the spooled image information.

12. An image forming apparatus comprising:

an image forming device, which forms an image on a sheet;

sheet processing equipment, which performs a predetermined process on the sheet;

a change-over controller, which selects either a first mode in which the predetermined process is executed on a sheet supplied to said sheet processing equipment by said image forming device, or a second mode in which a predetermined process is executed on a sheet supplied to said sheet processing equipment by a user, wherein if said change-over controller selects the first mode, said change-over controller carries out a selection before said image forming apparatus starts an image forming operation, and said change-over controller is inhibited from carrying out the selection after said image forming apparatus has started the image forming operation; and an inhibiting controller, which inhibits said image forming device from performing the image forming operation in response to a selection of the second mode by said change-over controller.

13. An image forming apparatus according to claim 12, wherein said inhibiting controller cancels an inhibition of a selection by said change-over controller after said image forming apparatus has discharged a last sheet to complete the image forming operation.

14. An image forming apparatus, which is attachable to a sheet processing apparatus, which includes a change-over controller to select either a first mode in which a predetermined process is executed on a sheet supplied by said image forming apparatus or a second mode in which a predetermined process is executed on a sheet supplied to the sheet processing apparatus by a user, said image forming apparatus comprising:

an image forming device for forming an image on the sheet;

a receiver for receiving, from a transmitter, information indicative of a mode selected by the change-over controller; and an inhibiting controller for inhibiting an image forming operation in response to the information received by said receiver indicating the second mode has been selected.

15. A printer driver program installed in and executed by a host computer in order to allow an image forming apparatus including: an image forming device, which forms an image on a sheet; sheet processing equipment, which performs a predetermined process on the sheet; a change-over controller, which selects either a first mode in which the predetermined process is executed on a sheet supplied to the sheet processing equipment by the image forming device, or a second mode in which a predetermined process is executed on a sheet supplied to the sheet processing equipment by a user; an inhibiting controller, which inhibits the image forming device from performing an image forming operation in response to a selection of the second mode by the change-over controller; and a notifying device, which is responsive to the selection of the second mode by the change-over controller that the second mode has been selected, and which notifies the computer that the second mode has been selected, the printer driver program comprising a program for executing the steps of:

determining whether a host computer is notified of the selection of the second mode in the sheet processing equipment, by the notifying device; and indicating that the image forming apparatus cannot execute the image forming operation, in a printer driver screen displayed on a display of the host computer, in response to a determination that the selection of the second mode is notified, in said determining step.

16. A printer driver program installed in and executed by a host computer in order to allow an image forming apparatus including: an image forming device, which forms an image on a sheet; sheet processing equipment, which performs a predetermined process on the sheet; a change-over controller, which selects either a first mode in which the predetermined process is executed on a sheet supplied to the sheet processing equipment by the image forming device, or a second mode in which a predetermined process is executed on a sheet supplied to the sheet processing equipment by a user; an inhibiting controller, which inhibits the image forming device from performing an image forming operation in response to a selection of the second mode by the change-over controller; and a notifying device, which is responsive to the selection of the second mode by the change-over controller that the second mode has been selected, and which notifies the computer that the second mode has been selected, said printer driver program comprising a program for executing the steps of:

determining whether a host computer is notified of the selection of the second mode in the sheet processing equipment, by the notifying device; and indicating that the second mode has been selected in the sheet processing equipment, in a printer driver screen displayed on a display of the host computer, in response to determination that the selection of the second mode is notified in said determining step.

* * * * *

UNITED STATES PATENT AND TRADEMARK OFFICE

CERTIFICATE OF CORRECTION

PATENT NO. : 6,850,719 B2
DATED : February 1, 2005
INVENTOR(S) : Takashi Nagaya

It is certified that error appears in the above-identified patent and that said Letters Patent is hereby corrected as shown below:

Drawings,
Sheet 9, Figure 10, “FORMIMG” should read -- FORMING --; and
Sheet 12, Figure 13, “FORMAING” should read -- FORMING --.

Column 5,
Lines 22 and 40, “change-ver” should read -- change-over --.

Column 6,
Line 11, “nor” should read -- not --.

Column 7,
Line 21, “post-2 treatment” should read -- post-treatment --; and
Line 28, “instrutions” should read -- instruction --.

Column 11,
Line 59, “image forming device” should read -- an image forming device --.

Signed and Sealed this

Seventh Day of June, 2005

JON W. DUDAS
*Director of the United States Patent and Trademark Office*